United States Patent [19]

Sharples

[11] 4,029,473

[45] June 14, 1977

[54] VESTIBULE VALVE REAGENT DISPENSER

[75] Inventor: Thomas Davy Sharples, Atherton, Calif.

[73] Assignee: Beckman Instruments, Inc., Fullerton, Calif.

[22] Filed: Oct. 31, 1975

[21] Appl. No.: 627,803

[52] U.S. Cl. ..... 23/259; 137/209; 222/399

[51] Int. Cl.[2] ..... B65D 83/00; B65D 83/14

[58] Field of Search ..... 23/259, 253 A, 230 A; 222/394, 399, 56; 137/209

[56] References Cited

UNITED STATES PATENTS

| | | | |
|---|---|---|---|
| 1,834,245 | 12/1931 | Kantor et al. | 137/209 |
| 3,531,258 | 9/1970 | Merrifield et al. | 23/253 R X |
| 3,536,450 | 10/1970 | Dus et al. | 23/253 R |
| 3,557,077 | 1/1971 | Brunfeld et al. | 23/259 |
| 3,909,205 | 9/1975 | Jones | 23/259 |

*Primary Examiner*—Robert M. Reese
*Attorney, Agent, or Firm*—R. J. Steinmeyer; P. R. Harder; R. S. Frieman

[57] ABSTRACT

An arrangement for the controlled delivery of liquid reagent is shown wherein a reservoir vessel for storing the liquid in volume is coupled to replenish a "vestibule vessel" provided for intermediate storage of the liquid enroute to the delivery point and for pneumatic propulsion thereof, the liquid being pneumatically driven from reservoir to the vestibule through a unidirectional check valve.

11 Claims, 3 Drawing Figures

VESTIBULE VALVE REAGENT DISPENSER

FIELD OF THE INVENTION

This invention relates to the dispensing of liquids, and especially to dispensing apparatus adapted for controlled delivery of reagent for peptide synthesis.

BACKGROUND; INVENTION FEATURES

Liquid dispensing systems in the present state of the art suffer certain shortcomings, especially with those systems adapted to carefully deliver reagent to peptide synthesis apparatus. For instance, in a typical reagent dispenser arrangement, liquid is driven from a reservoir pneumatically (i.e., by application of pressurized gas thereto) sufficient to dispense a relatively small volume of reagent for downstream reaction. Such dispensing systems are typically called upon to deliver a precisely-metered quantity of liquid reagent; such as solvent buffers and the like to a peptide synthesizer apparatus, for instance as shown in U.S. Pat. No. 3,531,258 to Merrifield et al, or in U.S. Pat. No. 3,557,077 to Brunfeldt et al (herein incorporated by reference).

Now, as workers know, the application and termination of a pneumatic pulse (e.g., pressurized air, or gas inert to liquid) to effect such a dispensing is a rather inexact science and various, relatively cumbersome controls have been resorted-to to better control the dispensing of such liquid. For instance, pneumatic pump means may be controlled to deliver reagent to a receiving reactor, being terminated at the proper time, and to the extent possible, when a prescribed "dose" is delivered. However, such systems typically suffer from poor control and relatively troublesome inertia effects — for instance, termination of applied pumping pressure is difficult to control precisely and will typically allow pumping to continue feeding liquid beyond the desired level ("over-shoot"). Of course various expedients have been resorted-to to handle this problem; for instance, venting of the pneumatic pumping system immediately upon cessation of driving pressure.

However, such venting, in itself, introduces certain problems. For instance, the vented gas can carry-off a certain portion of the liquid handled, especially where it is highly volatile, as is characteristic of many peptide synthesis reagents. By way of illustration, note the arrangement in U.S. Pat. No. 3,536,450 to Dus et al, where for chemical analytical purposes, a reagent is dispensed from a vessel (see vessel 41, FIG. 1) by applying pressurized gas to the liquid surface and thrust the liquid up a "riser" tube to its destination — here venting could likely deplete the liquid volume and possibly change the proportions of its constituents. That is, such a dispenser arrangement is typically terminated by interruption of dispensing pressure with contemporaneous pressure relief (venting to atmosphere) to achieve a fast pneumatic response. Now, obviously, to the extent any of the liquid contents (in vessel 41) are volatile under the operating conditions, they will, to a greater or lesser extent, be carried-off with the vented drive-gas. Moreover, since the storage vessel used is typically rather capacious and adapted to hold large volumes of liquid, it will typically require the application of relatively massive doses of pressurized gas to expel liquid; and when this gas volume is vented a good deal will be lost to atmosphere with each dispensing cycle.

Moreover, in instances where the dispensed liquids have a relatively high vapor pressure at the ambient conditions (e.g., temperature), evaporative losses of reagent will be quite high. This will not only prove expensive, but where the reagent includes organic solvents, it may present safety and air pollution problems. Also, such vapor loss through venting can seriously upset processing performances (e.g., peptide synthesis reactions) by virtue of allowing reagent concentration to shift, due to preferential vaporization of the more volatile constituents. This can become quite serious over a prolonged operating period of the system (e.g., through a series of many reagent-dispensing cycles). This is a special problem with certain reagent dispensers used in peptide synthesizers where, for instance, an unacceptable shift in the concentration of a critical semi-volatile reagent like anhydrous hydrochloric acid can occur (the acid being either dissolved in glacial acetic acid or in dioxane) due to acid evaporation during venting. Clearly such a loss becomes progressively more serious as the reagent volume in the storage vessel decreases, and after repeated venting cycles.

The present invention is adapted to provide a solution to such problems by use of a small intermediate vessel, or "vestibule chamber", at the outlet of a storage container, this chamber being independently pressure-evacuated and vented; and, preferably, automatically replenished.

More particularly, such problems are avoided with the invention by using such an intermediate vessel between a liquid-storage eservoir and the associated "use-station" in a system. For instance, the arrangement of the Dus patent above, can be so modified by interposition of such a vestibule chamber between reservoir 41 and receiving manifold 27. Thus, the pneumatic system driving liquid from a storage reservoir need not be vented at all, and need be operative only sufficient to maintain this vestibule chamber satisfactorily full, serving no delivery or metering function and requiring no pneumatic pumping for each small liquid volume dispensed. Similarly, since the volume of this intermediate chamber is relatively small, the mass of pumping gas needed for each liquid dose therefrom is likewise considerably reduced — as is the volume of gas vented with each dose and the overall dispensing-vessel air space and contained liquid volume (thus minimizing vent-evaporation).

Such arrangement according to the invention, will of course, also reduce the consumption of dispensing gas needed since much less will need be vented; also it can improve the response speed of the delivery system and its efficiency since the volumes of liquid and gas involved are so radically reduced, reducing the associated inertia and delay. Also, it will become relatively easier to assure that a prescribed volume of reagent is delivered more precisely as well as more quickly and simply, as will be recognized by workers in the art upon consideration of the following description.

Thus, it is an object of the present invention to provide improved techniques and associated apparatus for solving the foregoing problems and providing the foregoing features of advantage. A related object is to provide a reagent dispensing arrangement including an intermediate "vestibule chamber". Yet another object is to provide such an arrangement and such a chamber in conjunction with pneumatic reagent delivery means. Yet a further object is to provide a pneumatic reagent dispensing apparatus wherein the loss of vented gas and the associated loss of volatile reagent is reduced.

A related object is to reduce reagent evaporation with venting, as well as related shifts in reagent concentration. Still another object is to reduce reagent evaporation and solvent losses in peptide synthesis apparatus, as well as to minimize, if not eliminate, resulting air pollution and safety problems. Yet another object is to provide a reagent dispensing system for peptide synthesis apparatus exhibiting improved overall precision in metering and efficiency in delivery of reagent.

These and other objects of the invention will become more apparent from the following description and appended claims, reference being made to the accompanying drawings forming a part of the specification wherein like referenced characters denote corresponding parts in the several views.

IN THE DRAWINGS

While specific embodiments will now be described in detail and represent preferred embodiments of the present invention, it should be understood that this invention is not limited in application to the specific indicated details of construction and arrangement of parts, or to the associated techniques or modes of operation, or to what is illustrated in the accompanying drawings and described herein. Rather, the invention is capable of other embodiments and of being practised in various other ways within the scope of the appended claims as recognized by those skilled in the art. Thus it is to be understood that the terminology employed herein is only for purpose of description and not of limitation; with the invention's scope being limited only by the appended claims.

FIRST EMBODIMENT — FIG. 1

The embodiment in FIG. 1 will generally be understood to comprise an arrangement adapted to dispense reagent liquid in rather precisely controlled amounts, and originating from closed storage vessel 21', to a "use point" (discharge point), the liquid being stored and handled in a fractional volume according to the invention, in a closed intermediate vessel, or vestibule chamber 11', as hereinafter described.

Thus, a primary reservoir, or storage arrangement 20' is provided including a storage vessel 21' which has a relatively large capacity for liquid reagent R' (e.g., 100 ml in this application found suitable). Vessel 21' has an appropriate entry-orifice sealed by a suitable stopper 20'-S, through which is sealingly injected a pumping-gas inlet tube 20'-P, this tube extending preferably closely adjacent the bottom of vessel 21' and being adapted to introduce controlled amounts of pressurized gas from a regulated source PG'. An outlet conduit 1-I' is provided to couple the base of vessel 21' to a transfer vessel, or vestibule chamber, 11' (both vessels preferably being made of glass or other suitable material as known in the art), being introduced adjacent the base thereof through a prescribed relatively uni-directional orifice, "check valve" 13'. As described hereinafter in conjunction with FIG. 3, transfer vessel 11' is preferably located close to, but just above, the elevation of storage vessel 21'. The pressurized pumping atmosphere in vessel 21' (in the upper closed headspace 20-H thereof above liquid reagent R') will, in normal service, constitute air at a prescribed incremental pressure above atmospheric pressure, sufficient to drive reagent R' along conduit 1-I' and through check valve 13' to fill the smaller transfer vessel 11' (replenish reagent R'' therein). This is a "replenishment function" intended to maintain a prescribed liquid level in vessel 11' (here, understood as something close to the indicated "FULL" level), the pumping gas-pressure (variable) necessary for this being understood as that overcoming the difference (*hd*) between the variable liquid levels, i.e. level L—L of reagent R' in vessel 21', and the level in vessel 11'.

Figure 1:
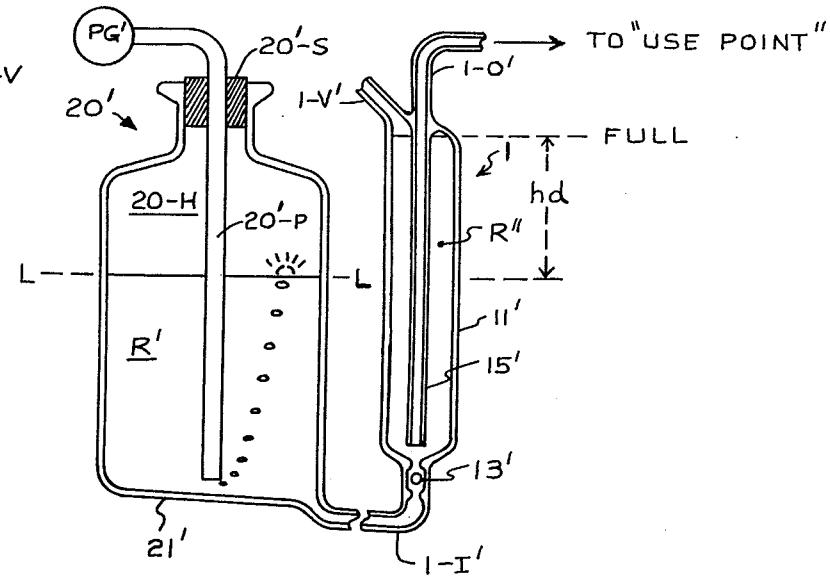
FIG. 1 is a schematic sectional illustration of a first embodiment of the invention.

Chamber 11' is also provided with a pressurizing conduit 1-V' through which pressurized dispensing gas may be applied or withdrawn, e.g., to expel a prescribed dose of reagent R'', up the centrally located riser tube 15', and out associated delivery conduit 1-0' to the "use point" as indicated in FIG. 1. The pressurized gas is controllably delivered from a regulated source PG' to accommodate the "head" (*hd*), or differential between liquid levels in the two vessels as known in the art. It may be noted that, preferably, the pumping-pressure line 20'-P in storage vessel 21' has its inlet end (orifice) close to the bottom of the vessel 21' to minimize operating variations caused by liquid volume changes, as the vessel's contents R' are withdrawn and its liquid level drops.

The companion case commonly assigned, namely U.S. Ser. No. 627,804, entitled Liquid Head Control System, filed on even date herewith, is hereby incorporated by reference and may be referred to for supplemental details (e.g., re replenishment control) not inconsistent herewith.

According to a feature of advantage, the inlet to transfer vessel 11' comprises a unidirectional check-valve 13', or like means, adapted to allow liquid to flow from storage vessel 21' only into, and not out of, vestibule vessel 11' in a relatively continual "replenishment mode", i.e., to refill to the "full" level in chamber 11' as indicated following withdrawals of reagent therefrom. Workers will recognize that when pressurized gas is applied (via valve means) through dispensing gas inlet I-V' to pressurize the reagent R'' in chamber 11', the check valve 13' will be seated closed and reagent R'' will be expelled. This will expel a prescribed dose (volume of R'') driven up the riser 15' and out 1-0', the dose volume determined according to termination of this pressure. Upon cessation of dispensing pressurization, a venting action is invoked to expel and withdraw pressurized gas back through inlet I-V', allowing the liquid pressure in 20' to unseat the check valve 13' and refill chamber 11'.

Preferably, the volume of vestibule 11' will be at least a bit larger than the greatest single reagent dose it will be required to deliver, so that vestibule 11' will never be completely emptied by any one delivery and will always have a minimum volume of reagent R'' remaining in the chamber to cover the lower end of riser tube 15' (e.g., about 20% larger than the maximum dose has been found suitable; or on the order of about 1–2 ml capacity for this embodiment). Thus, according to a supplemental feature hereof, any minor leakage through check valve 13' becomes relatively unimportant and the valve and associated conduits may be designed and arranged in a fashion which allows relatively minor backflow leakage from vestibule 11' into vessel 21' without compromising an adequate pneumatically driven delivery from the chamber. When the driving pressure through inlet I-V' is released (for example, responsive to a signal from the metering column of the synthesizer apparatus as indicated below relative to the embodiment of FIG. 3) the liquid out-flow will terminate very quickly, as workers in the art will appreciate. This is because the volume of reagent R'' operated upon is relatively small, as is the associated mass of pressurized gas needed to expel it (and then be vented from the head-space of the chamber).

Workers in the art will recognize that such an arrangement and others, whether suggested herein or not, operates to provide such significant advantages as radical reduction in needed dispensing gas and in that lost through venting, plus reduction in associated reagent losses with vent-evaporation, especially in the cases of solvent-reagent, and consequent elimination of problematical shifts and concentration in solvents because of such evaporation, as well as providing greatly improved operating response and superior overall precision of liquid-flow cut-off in an associated metering vessel.

Note that the pressurized gas source PG' may be so arranged and controlled (e.g., as indicated in the cited companion patent application) to apply sufficient pressure to storage head space 20-H to automatically replenish liquid in chamber 11' and maintain it at the indicated "full" level.

According to one feature of this invention, vestibule chamber 11' need only be provided with a relatively simple check valve 13' of a type well known in the art and adapted to be seated sealingly (e.g., against a resilient elastomeric seat or a glass seal as known in the art) to close the inlet orifice communicating with conduit 1-I', or an equivalent similarly functioning valve arrangement. For instance, a "flapper" type check valve or a "Bunsen" type check valve might be substituted in certain instances; or alternatively "tesla fluidic diode passages" might also be substituted for any "moving-element" valves in certain instances. Or, where a relatively long "filltime" is typically available for the replenishment of reagent R'' in chamber 11', a mere small-diameter orifice might be satisfactorily substituted rather than using any valve at all — operating to slowly and continually "leak" replenishment-liquid back into vessel 21' — e.g., once vessel 11' is "full". The latter expedient will serve to emphasize to those skilled in the art the extreme simplicity and advantageous operation of the liquid dispensing systems that are possible according to the invention, i.e., using such a vestibule chamber and associated pneumatic replenishment and delivery arrangements along with associated valving and related controls.

MODIFIED EMBODIMENT — FIG. 2

Figure 2:
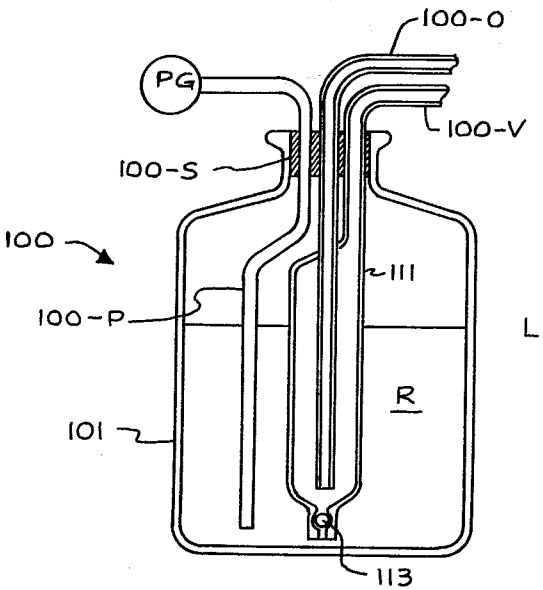
FIG. 2 is a like view of a second embodiment of the invention.

FIG. 2 illustrates an embodiment understood to be the same as the embodiment in FIG. 1 except as hereinafter described otherwise and comprising a relatively similar reservoir or storage arrangement 101 plus a relatively similar vestibule chamber 111; however, with this chamber being positioned within the storage vessel, rather than externally thereof as in the FIG. 1 embodiment.

More particularly, here a storage vessel 101 is provided for liquid reagent R and has an entry orifice closed by a sealing means 100-S. Vessel 101 will be understood as gas-pressurized, by a regulated gas source PG via a pressurizing riser 100-P introduced through seal 100-S and arranged and operated as above to pump reagent into a vestibule chamber 111. Chamber 111 is introduced through the entry orifice and may be suspended in storage vessel 101 to present a bottom inlet orifice, including a check valve 113, adjacent the bottom of vessel 101. Pressurizing and outlet conduits 100-V, 100-O, respectively, of chamber 111 are provided as before and may be introduced through seal 100-S and mounted therein. Of course the storage vessel 101 for this embodiment must provide a relatively wide-mouth orifice (at seal 100-S), to admit the vestibule chamber; however, it will be recognized by those skilled in the art that while this arrangement operates in approximately the same manner as the embodiment of FIG. 1, it is, for certain applications, somewhat more compact and convenient.

MODIFIED EMBODIMENT — FIG. 3

Figure 3:
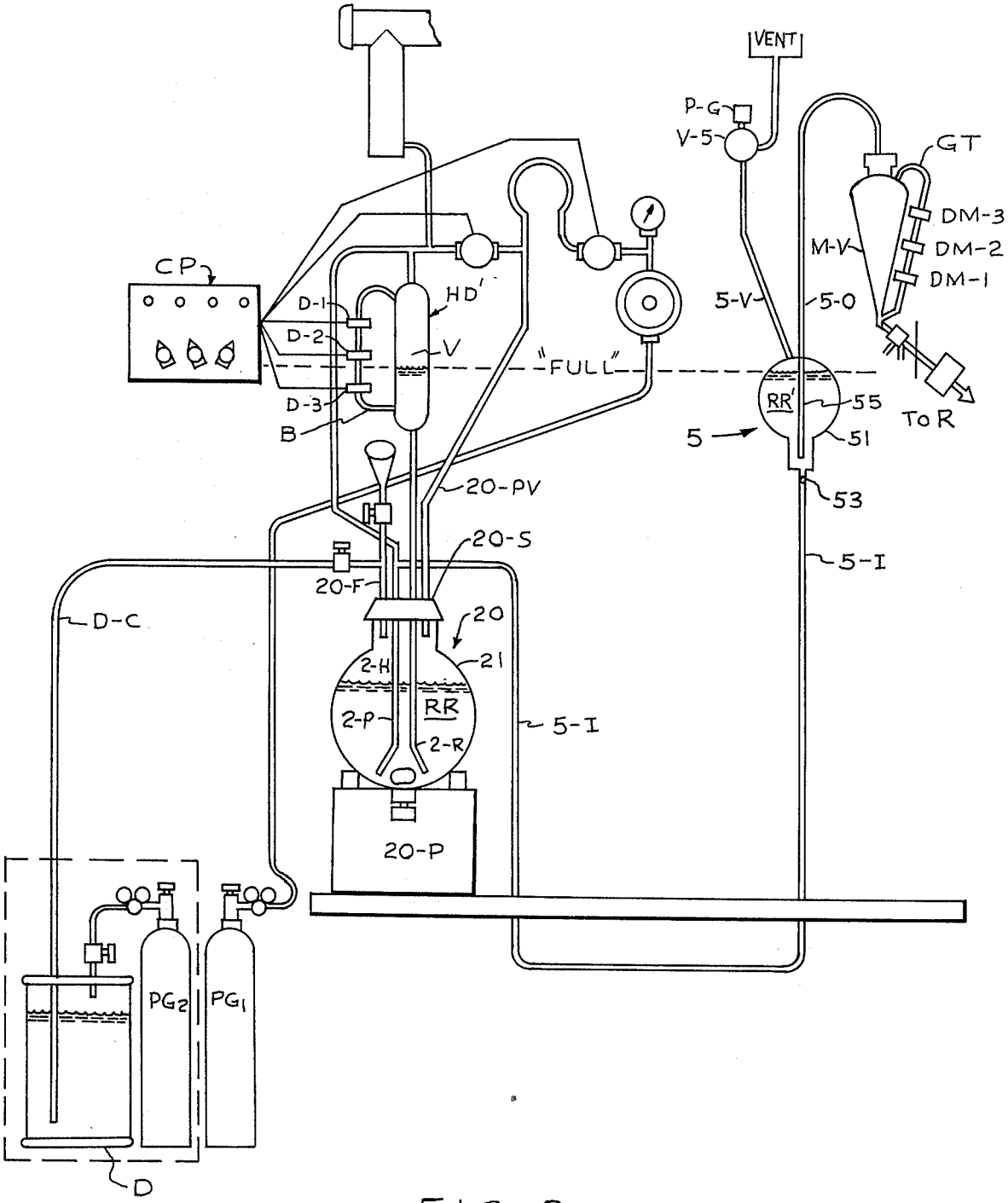
FIG. 3 is a schematic representation of a third embodiment which is functionally similar to the embodiment of FIG. 1, although modified somewhat, and is shown in operative association with peptide synthesizer apparatus.

FIG. 3 illustrates still another embodiment, being approximately the same in construction and operation to that shown in FIG. 1 and as described above, except where otherwise stated. This embodiment is shown in conjunction with details of the associated pneumatic liquid delivery arrangements and associated control means, plus various other incidents in a typical peptide synthesizer application.

More particularly here, the reservoir, or storage arrangement 20 will be understood as comprising a relatively massive storage flask 21 mounted on a pedestal 20-P and including an orifice sealed by appropriate sealing means 20-S through which are introduced a level control riser 2-R, an outlet riser 2-P, and a pressure-vent tube 20-PV. Tube 20-PV is connected, through appropriate valves and a pressure reducer, to a source of pressurized gas $PG_1$ and is adapted to expel reagent RR. Level control riser tube 2-R is provided to transfer stored reagent RR up to level detect unit HD, while outlet riser 2-P is adapted to pass liquid along a prescribed conduit 5-I for admission, through a ball-check valve 53, to a vestibule arrangement 5. Vestibule array 5 includes vestibule flask 51, dispensing-gas inlet 5-V and outlet riser 55, all arranged and operating in the manner of the embodiment of FIG. 1.

Thus, the introduction of a pescribed burst of pumping pressure into storage head space 2-H (via pressure inlet 20-PV) to a prescribed degree will apply a pneumatic pressure on the surface of reagent RR, drive it up riser 2-P along conduit 5-I, through valve 53, and into vestibule flask 51 to fill and replenish it to the prescribed indicated "FULL" level, as described before. Liquid will likewise be driven up riser 2-R to the same level in level detect unit HD'. Pedestal 20-P is disposed somewhat below the elevation of vestibule flask 51, but not so much as to require excessively high pumping pressures to transfer reagent therebetween.

As before, the pressurized dispensing gas is applied to vestibule flask 51 via conduit 5-V (from controlled pressurized gas source P-G via valve V-5) to pressurize the reagent RR' therein, thereby seating inlet check valve 53 and driving reagent RR' out the exit riser 55, and into metering vessel MV. Here, it is collected until the liquid level rise in MV is satisfactory, as detected by one of the associated photoelectric liquid level detectors DM-1, DM-2 and DM-3 located on a gauge tube G-T portion of M-V. Thereupon an electrical signal, supplied via appropriate electrical circuits (not shown but well known in the art), operates valve V-5 to release pressure and apply venting to the head space in flask 51. The flow of liquid through riser 5-0 stops immediately and any liquid in the line is drawn back by siphon action into the vestibule flask 51. Vestibule flask 51 is at a lower elevation than metering vessel MV to effect this "back-siphoning" action.

According to an ancillary feature of this embodiment, more fully explained in the above-cited companion patent application by Sharples, a control monitor is provided to indirectly monitor the level of liquid in vestibule flask 51 and thereby provide a continual automatic replenishment thereof from reservoir 20. Replenishment is invoked when the vestibule reagent level drops below the reference "FULL" level as detected at a level detect assembly HD', including a level-detect vessel V in hydraulic communication with transfer vessel 51 via conduit 5-I and riser 2-R. Using photosensor level detect means, or otherwise as known in the art, control signals are developed (e.g., from detect unit D-3) and applied to a control panel CP to cause pressurizing of reservoir head space 2-H whenever the vestibule liquid level falls below a reference level (here, "FULL").

A companion "over-full" detector D-2 is similarly provided and arranged, the signals therefrom being adapted to initiate controlled venting of chamber 51 (e.g., pulsatingly, as selectively controlled in pulse width and frequency at panel CP), once the vestibule liquid level has risen to, and above, the level of detector D-2. Of course, the fluid presence detectors D-1, D-2 and D-3 are positioned at any desired appropriate levels on bypass B of detector vessel V. Similarly, an "over-flow" detector D-1 is likewise provided and operated to invoke emergency venting alarm and reset conditions in the event of extreme overflow of a liquid in the vestibule chamber and associated conduits.

Other associated apparatus in this embodiment will be apparent in purpose and function to those skilled in the art. For instance, an arrangement for supplying for gross volume storage of reagent and replenishment thereof in storage vessel 21 is supplied in the form of a storage drum D and associated selectively operable pneumatic pressurized source $PG_2$, removably connected thereto, along with a riser and associated outlet tube D-C connecting with a fill tube 20-F, entering flask 21 via seal 20-S.

What is claimed is:

1. In an automatic liquid dispensing apparatus of the type having a closed storage vessel for containing a large quantity of liquid and having a bottom, means connected to said storage vessel for pressurizing said vessel, and fluid communication means having a first end and a second end, said first end connected to said storage vessel and said second end defining a discharge point, characterized in that said fluid communication means further comprises:

a. a closed intermediate vessel for containing a small quantity of said liquid and having a bottom, b. pressurizing means connected to said intermediate vessel for periodically pressurizing liquid therein to expel said liquid therefrom, and c. fluid control means for allowing passage of liquid from said storage vessel to said intermediate vessel when the pressure head in said storage vessel is greater than the pressure head in said intermediate vessel and restricting passage of liquid from said intermediate vessel to said storage vessel when the pressure head in said intermediate vessel is greater than the pressure head in said storage vessel.

2. The apparatus of claim 1 wherein said pressurizing means connected to said intermediate vessel comprises a gas pressurizing means.

3. The apparatus of claim 1 wherein said fluid control means comprises a check valve.

4. The apparatus of claim 1 wherein said intermediate vessel is located remote from said storage vessel and said fluid communication means further comprises an inlet fluid conduit means having one end terminating adjacent the bottom of said storage vessel and the other end connected adjacent the bottom of said intermediate vessel and an outlet fluid conduit means having one end terminating adjacent the bottom of said intermediate vessel and the other end defining said discharge point; wherein said fluid control means comprises a ball type check valve; and wherein said pressurizing means connected to said intermediate vessel comprises a gas pressurizing means.

5. The apparatus of claim 1 wherein said intermediate vessel is located within said storage vessel and said fluid communication means further comprises fluid conduit means having one end terminating adjacent the bottom of said intermediate vessel and the other end defining said discharge point; wherein said pressurizing means connected to said intermediate vessel comprises a gas pressurizing means; and wherein said fluid control means comprises a ball type check valve.

6. The apparatus of claim 1 wherein said intermediate vessel is located remote from said storage vessel and said fluid communication means further comprises an inlet fluid conduit means having one end terminating adjacent the bottom of said storage vessel and the other end connected adjacent the bottom of said intermediate vessel and an outlet fluid conduit means having one end terminating adjacent the bottom of said intermediate vessel and the other end defining said discharge point.

7. The apparatus of claim 6 wherein said fluid control means comprises a check valve.

8. The apparatus of claim 6 wherein said pressurizing means connected to said intermediate vessel comprises a gas pressurizing means.

9. The apparatus of claim 1 wherein said intermediate vessel is located within said storage vessel and said fluid communication means further comprises fluid conduit means having one end terminating adjacent the bottom of said intermediate vessel and the other end defining said discharge point.

10. The apparatus of claim 9 wherein said pressurizing means connected to said intermediate vessel comprises a gas pressurizing means.

11. The apparatus of claim 9 wherein said fluid control means comprises a check valve.

* * * * *